US005418488A

United States Patent [19]

Suquet

[11] Patent Number: 5,418,488

[45] Date of Patent: May 23, 1995

[54] DEVICE FOR ESTABLISHING A CURRENT IN AN ANALOG PART OF AN INTEGRATED LOGIC AND ANALOG CIRCUIT

[75] Inventor: Michel Suquet, Villeneuve-Tolosane, France

[73] Assignee: Siemens Automotive, S.A., Toulouse-Cedex, France

[21] Appl. No.: 39,341

[22] PCT Filed: Oct. 9, 1991

[86] PCT No.: PCT/EP91/01921

§ 371 Date: Jun. 16, 1993

§ 102(e) Date: Jun. 16, 1993

[87] PCT Pub. No.: WO92/07315

PCT Pub. Date: Apr. 30, 1992

[30] Foreign Application Priority Data

Oct. 16, 1990 [FR] France ..... 90 12735

[51] Int. Cl.[6] ..... G05F 1/10; G05F 3/02

[52] U.S. Cl. ..... 327/540; 327/541

[58] Field of Search ..... 307/296.01, 296.04, 307/296.06, 270; 327/77, 78, 538, 540, 541

[56] References Cited

U.S. PATENT DOCUMENTS 4,082,998 4/1978 Marriott ..... 307/296.1
4,763,021 8/1988 Stickel ..... 307/475
4,894,562 1/1990 Cavaliere ..... 327/538
4,940,930 7/1990 Detweiler ..... 323/273
5,180,927 1/1993 Poletto ..... 307/296.4

FOREIGN PATENT DOCUMENTS 0103455 3/1984 European Pat. Off. .
0333353 9/1989 European Pat. Off. .
58-54412 3/1983 Japan .
2056805 3/1981 United Kingdom .

*Primary Examiner*—William L. Sikes
*Assistant Examiner*—Tiep H. Nguyen
*Attorney, Agent, or Firm*—Herbert L. Lerner; Laurence A. Greenberg

[57] ABSTRACT

The device comprises (a) an external impedance ($R_{ext}$) connected up between a voltage source (E) for powering the circuit and a pin (4) connected to a high-impedance input (3) of the logic part of this circuit, (b) a branch of the analogue circuit, connected up between this pin (4) and the earth of the circuit and, (c) a circuit (5) transmitting logic signals and connected up to this pin (4) by a logic output (6) which offers a high impedance in one of its two logic states, a specified current being established in the said pin when the said output is in the high-impedance state.

Application to the limitation, regulation, directing or measuring of the current in a load outside the integrated circuit.

15 Claims, 2 Drawing Sheets

DEVICE FOR ESTABLISHING A CURRENT IN AN ANALOG PART OF AN INTEGRATED LOGIC AND ANALOG CIRCUIT

BACKGROUND OF THE INVENTION

Field of the Invention

The present invention relates to a device for establishing a current in an analogue part of an integrated logic and analogue circuit. More particularly, the present invention relates to such a device designed for establishing such a current in a so-called "intelligent" integrated power circuit.

Integrated circuits are known comprising input and/or output pins designed to receive or transmit digital signals which are processed or formulated in a logic part of the circuit, and to control analogue output quantities. The so-called "smart" power circuits are examples of such circuits in which digital control and/or diagnostic signals are processed in a logic part adjoining an analogue part comprising a power transistor controlling the flow of a powering current in a load outside the circuit.

In such a circuit there may be a need for a reference current, for example in order to ensure a correct biasing of a sub-circuit, or in order to limit, direct or regulate an output current powering a load. Now, present methods of manufacturing integrated circuits do not allow the direct construction of precise internal current sources. Recourse must then be had to internal methods of adjustment or to means of adjustment based on external components such as a resistor.

Internal methods of adjustment, which call upon the use of so-called "ZAP" Zener diodes, fuses or programmable memories, bring about an increase in the surface area of the chip embodying the integrated circuit. Furthermore, the implementing of the method of adjustment increases the manufacturing time and number of rejects when sorting the manufactured chips. This solution is not viable when seeking as economical a manufacture as possible.

Power supplies use frequently external components like external resistors or application of external voltage to adjust some parameters. As an example, patent application EP 103 455 describes a power supply unit in which regulated output voltage can be switched between two operating values (high and low voltage) by application of a control voltage to a control terminal. In the same way, document "Les alimentations de laboratoire" published in "Electronique Applications" n°24 (June 1982) teaches a power supply in which remote control of current is adjusted by a voltage or a resistor connected between specialised pins of the circuit.

However, use of an external resistor entails the presence of an additional specialised pin on the casing of the chip and of the corresponding connection lug on the chip itself, arrangements which also raise the price of the manufactured product. The two known methods are not therefore economical, this being especially harmful in the case of low cost price, high volume manufacture such as encountered in automobile electronics.

The aim of the present invention is therefore to construct a device for establishing a current in an analogue part of an integrated logic and analogue circuit, which calls upon neither an internal adjustment nor an external resistor connected up to a specialised pin of the circuit.

The aim of the present invention is also to construct such a device which is of especially economical construction.

SUMMARY OF THE INVENTION

These aims of the invention are achieved, as well as others which will emerge in the remainder of the present description, with a device for establishing a current in an analogue part of an integrated logic and analogue circuit, notable in that it comprises (a) an external impedance connected up between a voltage source for powering the circuit and a pin connected to a high-impedance input of the logic part of this circuit, (b) an internal branch of the analogue circuit, connected up between this pin and the earth of the circuit and, (c) an external circuit transmitting logic signals and connected up to this pin by a logic output which offers a high impedance in one of its two logic states, a specified current being established in the said branch when the said output is in the high-impedance state.

By using thus a logic input pin of the integrated circuit for establishing the current sought in this circuit, there is an advantageous saving of the specialised pin which was required prior to the invention.

According to a first embodiment of the device according to the invention, the device comprises means for regulating voltage across the terminals of the external impedance when the logic output of the transmitter circuit is in the high-impedance state, so as to adjust the intensity of the current flowing in the branch of the analogue part connected up to this external impedance in series.

According to an embodiment of internal means of regulating the integrated circuit, these means comprise an internal reference voltage source, a transistor for testing the current circulating in the branch of the analogue part of the circuit in series with the external impedance, and a comparator whose inputs are powered by the reference voltage source and by the voltage established on the logic input pin of the circuit, the output of the comparator controlling the switching on of the transistor.

According to a first application of the device according to the invention, the analogue part comprises means for duplicating several times the current circulating in the branch connected up to the external impedance, in so many biasing sub-circuits used in the integrated circuit.

According to a second application of the device according to the invention, the analogue part comprises a transistor for testing the flow of a current in a load outside the circuit, the logic part of the circuit controlling this transistor in switch mode. The analogue part may then comprise means for regulating the intensity of the current flowing in the said load as a function of that of the current established in the branch of this part which is connected up to the external impedance in series.

According to a variant, the analogue part comprises means for regulating the intensity of the current flowing in the external impedance as a function of the current circulating in the load. The current in this load may then be measured from a measurement of voltage across the terminals of the external reference.

According to another variant, the logic part of the integrated circuit comprises means for controlling a limitation in the current in the load. A starter circuit is then placed between the input of the logic part and a test electrode of the transistor for testing the flow of a current in the load.

Other characteristics and advantages of the device according to the invention will emerge on reading the following description and on examining the attached drawing in which:

DESCRIPTION OF THE PREFERRED EMBODIMENT

Figure 1:
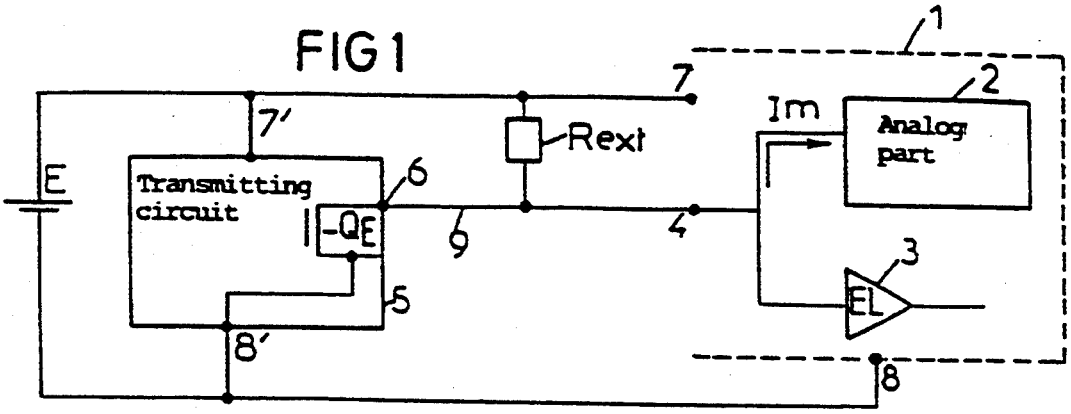
FIG. 1 is a diagram of the device according to the invention.

Reference is made to FIG. 1 of the attached drawing in which th schematised device comprises an integrated circuit 1 having an analogue part 2 and a logic part powered via at least one logic input EL 3 connected up to an input pin 4 of the integrated circuit. A second so-called transmitter circuit 5 comprises an output pin 6 which transmits logic signals which are collected by the pin 4 of the integrated circuit by virtue of a line 9, in order to be processed in the logic part of this circuit. A voltage source E is connected up to the power terminals 7, 8 and 7', 8' of the circuits 1 and 5 respectively.

According to an essential characteristic of the device according to the invention, the importance of which will be explained below, a current generator is connected up between the pins 7 and 4 of the circuit 1. This generation of current can be established via an impedance and, preferably, via a simple pure resistance $R_{ext}$, as shown, or via any other means of generating current known in microelectronics.

The external resistor $R_{ext}$ also connected up between the positive terminal of the voltage source E and the logic output 6 of the transmitter circuit 5. As schematised by way of example by the transistor $Q_E$ of the MOS type, this output is of the bare drain type which sets a single logic state on the output 6, for example a "low" state, by switching on the transistor $Q_E$. The other, "high", logic state is regulated by the resistor $R_{ext}$ which can be adjusted with precision since it is outside the integrated circuit 1.

Figure 2:
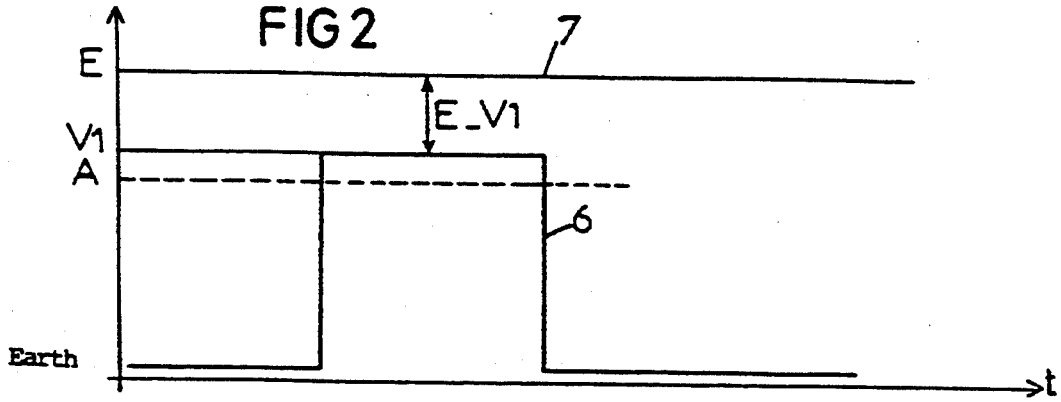
FIG. 2 represents graphs of voltage which are useful in explaining the functioning of the device according to the invention.

In FIG. 2, the graph referenced 6 illustrates the two possible logic states established on the output 6 of the circuit 5. The logic input 3 of the circuit 1 is sensitive to a logic signal of level greater than the level A, less than E. The current admitted by the logic input 3 can be regarded as negligible, if this input is constructed with MOS technology for example.

In the "high" state, the analogue part 2 of the integrated circuit 1 sets a voltage difference $E-V_1$ across resistor $R_{ext}$. According to the invention, this voltage $V_1$ lies between A and E (see FIG. 2).

Under these conditions, it is appreciated that the current $I_m$ which enters the analogue part 2 of the integrated circuit 1 is such that:

$$I_m=(E-V_1)/R_{ext}$$

when the output 6 of the circuit 5 is in the "high-impedance" state. Indeed, comsumption by this output is then negligible as is that by the logic input 3.

Whatever the variations in the powering voltage E, as long as the voltage $V_1$ does not drop below the threshold A, the current $I_m$ may be used by the analogue part 2 of the circuit 1 as a reference current, adjusted by the precision external resistor $R_{ext}$ which then acts as reference current generator.

Clearly, this is only possible if the integrated circuit 1 does not need to be permanently powered by a reference current. The reference current is available only when the output 6 is in the "high-impedance" state, in order to avoid any power consumption this way. It is on this account that, according to the invention, there is an advantageous saving of one pin in the manufacture of the integrated analogue and digital circuit 1. Particularly in connection with FIGS. 4 and 5, examples of application of the device according to the invention will be seen below in which this partial availability in time of a reference current is without disadvantage.

Figure 3:
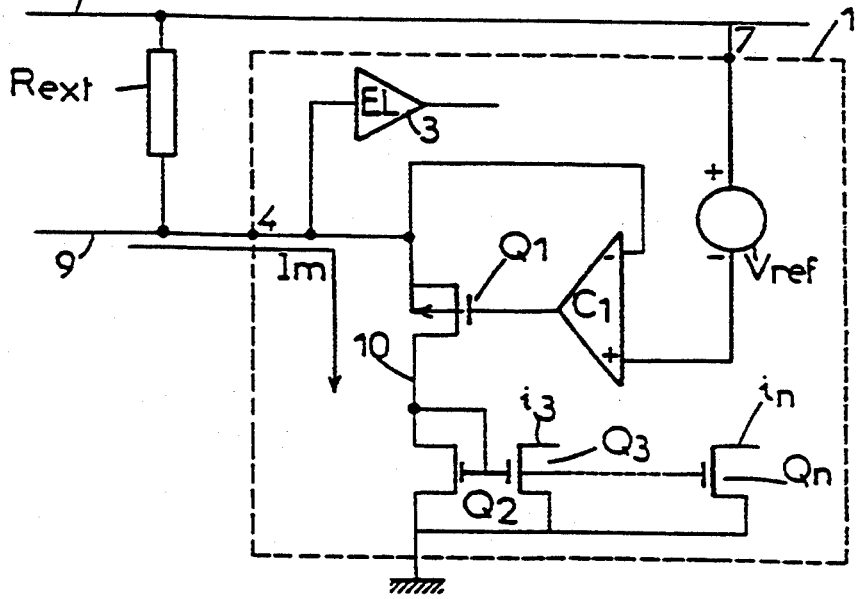
FIG. 3 is a wiring diagram of a first embodiment of the device according to the invention.

Having thus explained the principle upon which the present invention is based, reference is made to FIG. 3 of the drawing in which a first embodiment of the device according to the invention has been represented, applied for example to the biasing of sub-circuits internal to the integrated circuit 1.

In this Figure there is again found the resistor $R_{ext}$ connected up between a line at the voltage E and the pin 4 of the circuit 1, which pin is controlled via a logic output of a transmitter circuit (not shown) such as the circuit 5 of FIG. 1. In the "high-impedance" state of this output, it is appreciated that the current $I_m$ entering the circuit via the pin 4 is regulated by a conventional regulator consisting of the comparator $C_1$ controlling a transistor $Q_1$ of the MOS type for example, whose drain-source circuit is placed in series with the resistor $R_{ext}$. The positive terminal of the comparator $C_1$ is connected up to a reference voltage source $V_{ref}$ internal to the circuit 1 (a Zener diode for example) whilst the negative terminal of this comparator is connected up to the pin 4. The voltage $(E-V_1)$ is then driven to $V_{ref}$ by the regulator ($C_1$, $Q_1$) belonging to the analogue part of the circuit.

The current $I_m$ enters a branch 10 of the analogue part of the integrated circuit 1 connected up between the pin 4 and earth. This current is such that:

$$I_m=V_{ref}/R_{ext}.$$

The current $I_m$ thus regulated can constitute a precise internal reference current.

A transistor $Q_2$ assembled in series with the transistor $Q_1$ is assembled in current-reflector mode with a plurality of transistors $Q_3$ to $Q_n$ drawing precise reference currents $i_3$ to $i_n$, which are images of $I_m$ and hence suitable for use in biasing so many sub-circuits of the integrated circuit 1. This is therefore a first application of the device according to the invention.

Figure 4:
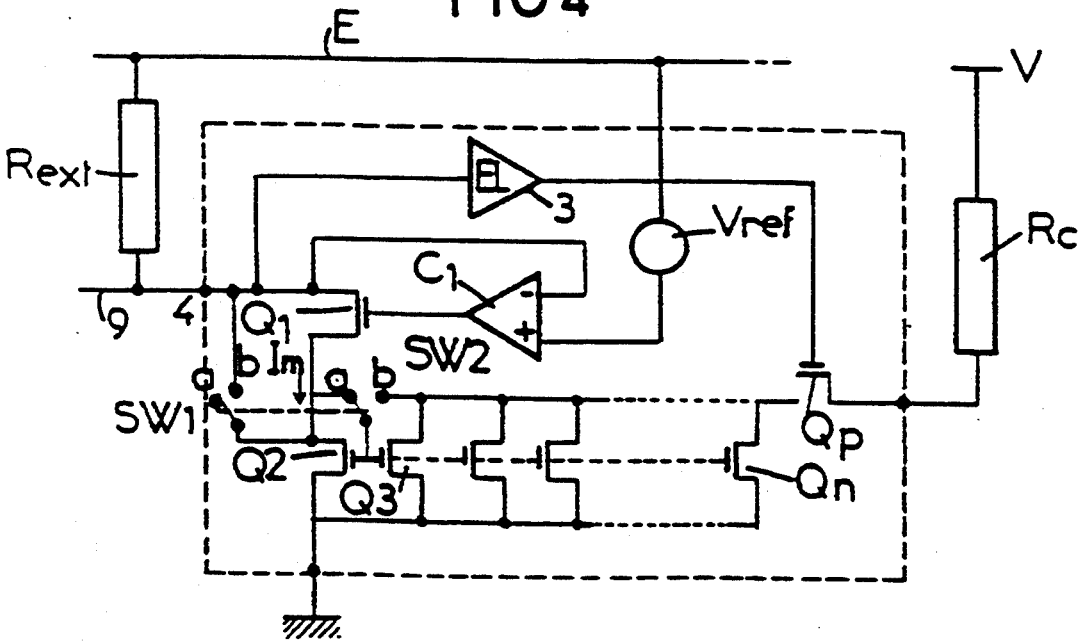
FIG. 4 is a wiring diagram of a second embodiment of the device according to the invention, applied to the control or to the measuring of the current in a load external to the integrated circuit.
Figure 5:
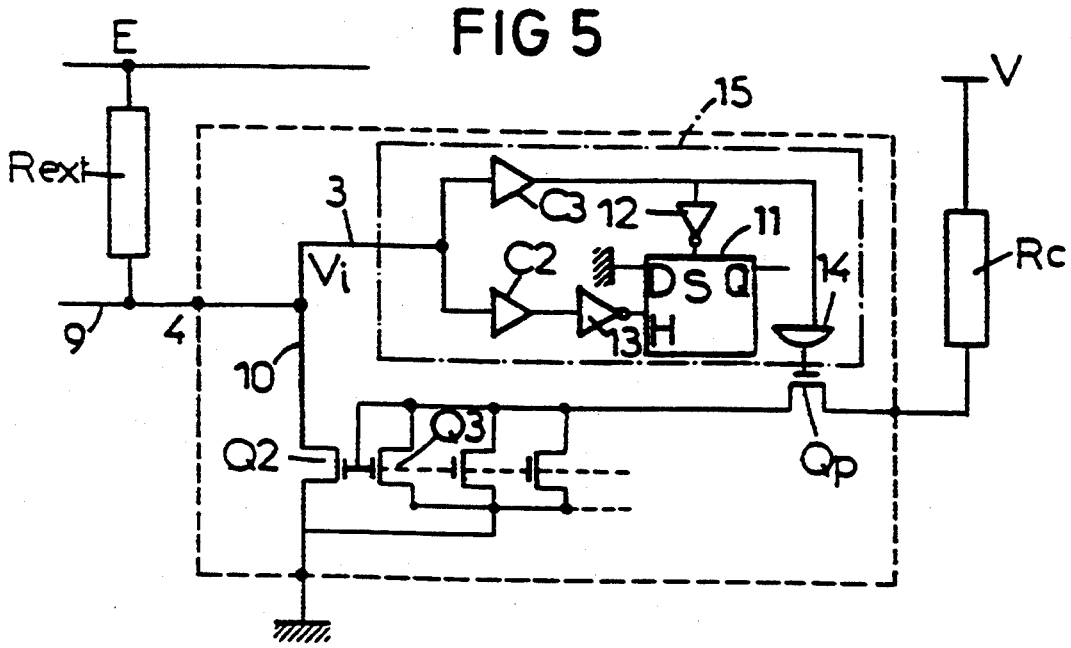
FIG. 5 is a wiring diagram of a variant of the device of FIG. 4.

Other applications are illustrated by the embodiments of FIGS. 4 and 5. In these Figures and in the preceding Figures, identical references label identical or similar elements or units.

Thus, in the device of FIG. 4 there are again found the regulator ($C_1$, $Q_1$) of the device of FIG. 3 and the current-reflector assembly of transistors ($Q_2$, $Q_3$ to $Q_n$).

Currents which traverse a load $R_c$ powered by a voltage source V flow in cells $Q_3$ to $Q_m$ of the current reflector. The logic input 3 tests the gate of a transistor $Q_p$ which controls, in all-or-nothing mode, the flow of the current in the load, on the input side of the current reflector. There has thus been represented a part of an "intelligent" power circuit designed to control the powering of the load and to, possibly, diagnose operating faults in the load or in the circuit, with the aid of means which are not shown.

Two different applications are illustrated, each one corresponding to one of the positions a and b of two coupled two-position switches ($SW_1$, $SW_2$). The switch $SW_1$ is ineffectual in position a and short-circuits the requlator ($C_1$, $Q_1$) in position b. The switch $SW_2$ is installed between the gates of the transistors on the one hand, and the pin 4 (position a), or the drains (for example) of the transistors $Q_3$ to $Q_n$ (position b) on the other hand.

When the switches are in position a, as shown in the Figure, the current $I_m$ is duplicated in the cells $Q_3$ to $Q_n$ of the current reflector, the current in the load $R_c$ then consisting of the sum of the current in these cells. With this assembly it is clear that the current in the load $R_c$ can be set by suitably regulating $I_m$, by affecting the value of the external impedance $R_{ext}$ or the value of the reference voltage $V_{ref}$. This is a second application of the device according to the invention.

When the switches are closed on the contact b, it is by contrast the current in the load which is duplicated in the branch of the analogue part of the circuit, which is connected up in series with the external impedance $R_{ext}$, by way of the drain-source circuit of the transistor $Q_2$ and of the switch $SW_1$ which short-circuits the transistor $Q_1$. It will be noted that the switch $SW_1$ is necessary in order to avoid any disturbance which might be created by the regulator circuit ($C_1$, $Q_1$).

By measuring the voltage across the terminals of the external impedance $R_{ext}$, with the aid of known means (not shown) the current circulating in the load can at once be measured. This is a further application of the device according to the invention.

FIG. 5 represents a variant of the device of FIG. 4, designed to ensure automatic cutting (tripping) of the current in the load $R_c$ when the intensity of this current tends to exceed a certain value. As seen in FIG. 5, the logic input 3 controls the transistor $Q_p$ across a discriminating circuit 15 whose role will be explained below.

It will be observed that the duplicating of the load current in the input circuit ($R_{ext}$, $Q_2$) makes the input voltage $V_i$ of the logic input 3 drop from the value:

$$R_{ext} \times I_m.$$

When, due to the current $I_m$ exceeding a setpoint value, this input voltage drops below the flipover threshold for the logic input (see FIG. 1), the transistor $Q_p$ is switched off and hence the current in the load is cut. The desired tripping is thus obtained. However, due to the cutting of the current in the load, the voltage $V_i$ rises back above the switching threshold for the logic input which, in the absence of any countermeasure, would have the effect of switching the load back on.

To avoid this switching back on, after tripping, which could damage the load and the integrated circuit, the invention proposes to use the abovementioned discriminating circuit 15 installed between the logic input 3 and the transistor $Q_p$.

It will be observed that the comparator for the logic input 3 of the preceding embodiments has been omitted and replaced by two comparators $C_2$, $C_3$ sensitive respectively to (high) $V_{1b}$ and (low) $V_{1b}$ threshold crossings respectively, the threshold $V_{1b}$ corresponding to the desired tripping threshold, and $V_{1b} < V_{1b}$.

It will be noted that the max current in the load will be defined via $R_{ext}$ as a function of the threshold $V_{1b}$ via the relationship $I_{max} = k(E-V_{1b})/R_{ext}$ where k is the ratio of the currents, defined by the number of transistors $Q_3$ to $Q_n$.

The circuit 15 furthermore comprises a flip-flop 11 of the D type whose inputs S and H (clock) are connected up, across inverters 12, 13 respectively, to the outputs of the comparators $C_3$ and $C_2$ respectively. The input D of the flip-flop is earthed. The output Q of the flip-flop is connected up to an input of an AND gate 14 comprising another input connected up to the output of the comparator $C_3$.

When the integrated circuit is placed in the active state, the voltage $V_i$ rises, and passes through the threshold $V_{1b}$, which brings about:

1) the passing to 1 of the output of the comparator $C_3$ and hence of one of the inputs of the AND gate 14,
2) the passing to 0 of the output of the inverter 12 which sets the output Q of the flip-flop 11 to 1 as well therefore as the other input of the AND gate 14.

The output of the AND gate then passes to the 1 state bringing about the switching of the transistor $Q_p$.

Upon exceeding the accepted maximum intensity in the load $R_c$, the voltage $V_i$ drops beneath the threshold $V_{1b}$ bringing about a downward transition at the output of the comparator $C_2$, and hence an upward transition on the input H of the flip-flop 11 by way of the inverter 13. This transition then brings about the passing of the output Q to the logic state of the input D, that is to say 0. The AND gate is then deactivated and the current in the load $R_c$ is cut by the transistor $Q_p$. The rising back of the voltage $V_i$ as explained earlier brings about a downward transition on the input H which has no effect.

The rearming of the circuit 15 can then only take place via a passing of the external control through the (inactive) 0 state, and a return to the active state as described above.

I Claim;

1. A combination, comprising:

an integrated logic and analog circuit having a logic part and an analog part;

said logic part of said integrated circuit including a high-impedance input and an input terminal connected to said high-impedance input;

a voltage source connected to said integrated circuit for powering said integrated circuit;

a device for establishing a specified current in said analog part of said integrated circuit;

said device including impedance means having a first lead connected to said voltage source and a second lead connected to said high-impedance input of said logic part;

said analog part of said integrated circuit including an internal branch connected between said input terminal and common ground of said integrated circuit; and said device including a transmitter circuit connected to said integrated circuit, said transmitter circuit having a high-impedance output connected to said input terminal and having a first logic state outputting a high-impedance state and a second logic state, said high-impedance output being means for establishing the specified current in said internal branch when said high-impedance output is in said first logic state.

2. The combination according to claim 1, wherein said impedance means are external impedance means and said first and second leads are connected externally of said integrated circuit between said input terminal and one branch of said voltage source.

3. The combination according to claim 2, including means for regulating a voltage across said terminals of said external impedance when said logic output of said transmitter circuit is in said first logic state, for adjusting an intensity of a current flowing in said internal branch of said analog part connected to said input terminal.

4. The combination according to claim 3, wherein said regulating means are disposed internally of said integrated circuit.

5. The combination according to claim 4, wherein said regulating means include an internal reference voltage source, a transistor for testing the current flowing in said internal branch of said analog part of said integrated circuit, and a comparator having inputs being powered by said reference voltage source and by a voltage established on said input terminal, an output of said comparator being connected to said transistor for switching said transistor.

6. The combination according to claim 2, wherein said external impedance means are formed by a resistance.

7. The combination according to claim 2, wherein said external impedance means are formed by a current generator.

8. The combination according to claim 1, including a biasing sub-circuit in said analog part of said integrated circuit, said biasing sub-circuit being connected to said impedance means and including means for duplicating the current flowing in said internal branch.

9. The combination according to claim 1, wherein said analog part comprises a transistor for testing a flow of a current in a load outside said integrated circuit, said transistor being connected to said logic part of said integrated circuit and being controlled by said logic part in a switch mode.

10. The combination according to claim 9, wherein said analog part is connected in series with said external impedance and further comprises means for regulating an intensity of the current flowing in the load as a function of an intensity of the specified current established in said internal branch.

11. The combination according to claim 10, wherein said load current regulating means include a current-mirror assembly of transistors.

12. The combination according to claim 9, wherein said analog part further comprises means for regulating an intensity of a current flowing in said external impedance as a function of the current flowing in the load.

13. The combination according to claim 12, wherein said external impedance current regulating means include a current-mirror assembly of transistors connected between the load and said internal branch of said analog part.

14. The combination according to claim 9, wherein said logic part of said integrated circuit further comprises control means for controlling a limitation in the current flowing in the load.

15. The combination according to claim 14, wherein said control means include a discriminating circuit connected between said high-impedance input of said logic part and a test electrode of said transistor for testing the flow of current in the load, said discriminating circuit including means sensitive to a direction of crossing of a voltage threshold on said high-impedance input for preventing spurious switching-on of said transistor after a switching-off of said transistor for limiting the current in the load.

* * * * *